US008241044B2

(12) United States Patent
Mostoller et al.

(10) Patent No.: US 8,241,044 B2
(45) Date of Patent: Aug. 14, 2012

(54) LED SOCKET ASSEMBLY

(75) Inventors: Matthew Edward Mostoller, Hummelstown, PA (US); Christopher George Daily, Harrisburg, PA (US); Charles Raymond Gingrich, III, Mechanicsburg, PA (US); Ronald Martin Weber, Annville, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 163 days.

(21) Appl. No.: 12/634,517

(22) Filed: Dec. 9, 2009

(65) Prior Publication Data

US 2011/0136394 A1 Jun. 9, 2011

(51) Int. Cl.
*H01R 12/00* (2006.01)
*F21V 23/04* (2006.01)

(52) U.S. Cl. ..... 439/56; 439/699.2; 439/602; 362/646; 362/249.02

(58) Field of Classification Search ..... 362/249, 362/49.02, 49.01, 665, 662, 640, 646, 249.02, 362/249.01; 439/56, 487, 404, 928, 701, 439/602, 699.2
See application file for complete search history.

(56) References Cited

U.S. PATENT DOCUMENTS

| | | | | |
|---|---|---|---|---|
| 5,038,255 | A | 8/1991 | Nishihashi et al. | |
| 5,283,716 | A | 2/1994 | Banitt et al. | |
| 5,378,158 | A * | 1/1995 | Owen et al. | 439/57 |
| 5,404,282 | A | 4/1995 | Klinke et al. | |
| 5,660,461 | A | 8/1997 | Ignatius et al. | |
| 6,318,886 | B1 | 11/2001 | Stopa et al. | |
| 6,541,800 | B2 | 4/2003 | Barnett et al. | |
| 6,667,544 | B1 | 12/2003 | Glenn | |
| 6,793,369 | B2 * | 9/2004 | Calzaretta et al. | 362/219 |
| 6,817,735 | B2 | 11/2004 | Shimizu et al. | |
| 6,911,731 | B2 | 6/2005 | Wu | |
| 6,999,318 | B2 | 2/2006 | Newby | |
| 7,306,353 | B2 | 12/2007 | Popovich et al. | |
| 7,322,718 | B2 | 1/2008 | Setomoto et al. | |
| 7,348,604 | B2 | 3/2008 | Matheson | |
| 7,400,029 | B2 | 7/2008 | Shimada et al. | |
| 7,510,400 | B2 * | 3/2009 | Glovatsky et al. | 439/56 |
| 7,540,761 | B2 | 6/2009 | Weber et al. | |
| 7,549,786 | B2 | 6/2009 | Higley et al. | |
| 7,553,162 | B2 * | 6/2009 | Isoda et al. | 439/56 |
| 7,621,752 | B2 * | 11/2009 | Lin et al. | 439/56 |
| 7,677,763 | B2 * | 3/2010 | Chan | 362/249.02 |
| 7,686,477 | B2 * | 3/2010 | Southard et al. | 439/404 |

(Continued)

FOREIGN PATENT DOCUMENTS

DE 19818402 10/1999

(Continued)

*Primary Examiner* — Briggitte R Hammond

(57) ABSTRACT

A socket assembly includes a light emitting diode (LED) package having an LED printed circuit board (PCB) with an LED mounted thereto. The LED package has a power contact configured to receive power from a power source to power the LED. The socket assembly also includes a socket housing having a receptacle that removably receives the LED package. The socket housing has a securing feature engaging the LED PCB to secure the LED PCB within the receptacle, where the securing feature is configured to release the LED PCB to remove the LED PCB from the receptacle. Optionally, the socket housing may include mounting features configured to mount the socket housing to a base, where the LED package is removable from the socket housing while the socket housing remains mounted to the base. A second LED package may be provided, where the LED package is removable from the receptacle and is replaced by the second LED package.

20 Claims, 9 Drawing Sheets

U.S. PATENT DOCUMENTS

| | | | | |
|---|---|---|---|---|
| 7,744,266 | B2 * | 6/2010 | Higley et al. | 362/646 |
| 7,963,674 | B2 * | 6/2011 | Takekuma et al. | 362/249.04 |
| 2002/0113244 | A1 | 8/2002 | Barnett et al. | |
| 2002/0114155 | A1 | 8/2002 | Katogi et al. | |
| 2002/0176250 | A1 | 11/2002 | Bohler et al. | |
| 2003/0063463 | A1 | 4/2003 | Sloan et al. | |
| 2003/0094893 | A1 | 5/2003 | Ellens et al. | |
| 2003/0112627 | A1 | 6/2003 | Deese | |
| 2003/0189829 | A1 | 10/2003 | Shimizu et al. | |
| 2004/0175189 | A1 | 9/2004 | Weber-Rabsilber et al. | |
| 2004/0252501 | A1 | 12/2004 | Moriyama et al. | |
| 2004/0264195 | A1 | 12/2004 | Chang et al. | |
| 2005/0045904 | A1 * | 3/2005 | Chen | 257/100 |
| 2005/0077623 | A1 * | 4/2005 | Roberts et al. | 257/724 |
| 2005/0152146 | A1 | 7/2005 | Owen et al. | |
| 2005/0243558 | A1 | 11/2005 | Van Duyn | |
| 2006/0091410 | A1 | 5/2006 | Chen | |
| 2006/0262533 | A1 * | 11/2006 | Lin et al. | 362/249 |
| 2006/0279949 | A1 * | 12/2006 | Shin et al. | 362/236 |
| 2007/0025103 | A1 | 2/2007 | Chan | |
| 2007/0103932 | A1 * | 5/2007 | Hsieh et al. | 362/561 |
| 2007/0246712 | A1 | 10/2007 | Kim et al. | |
| 2008/0130275 | A1 * | 6/2008 | Higley et al. | 362/184 |
| 2008/0220631 | A1 * | 9/2008 | Isoda et al. | 439/74 |
| 2008/0266858 | A1 * | 10/2008 | Southard et al. | 362/249 |
| 2008/0315214 | A1 | 12/2008 | Wall, Jr. et al. | |
| 2009/0009103 | A1 | 1/2009 | McKechnie et al. | |
| 2009/0009998 | A1 | 1/2009 | Malstrom et al. | |
| 2009/0023323 | A1 * | 1/2009 | Lin et al. | 439/345 |
| 2009/0108281 | A1 | 4/2009 | Keller et al. | |
| 2009/0130889 | A1 | 5/2009 | Daily et al. | |
| 2009/0146919 | A1 | 6/2009 | Kline et al. | |
| 2009/0207609 | A1 * | 8/2009 | Higley et al. | 362/235 |

FOREIGN PATENT DOCUMENTS

| | | |
|---|---|---|
| DE | 10319525 | 11/2004 |
| EP | 1098135 | 5/2001 |
| WO | WO 0173844 | 10/2001 |

* cited by examiner

LED SOCKET ASSEMBLY

CROSS REFERENCE TO RELATED APPLICATIONS

This Application Relates to U.S. patent application Ser. No. 12/634,416 titled SOLID STATE LIGHTING ASSEMBLY, U.S. patent application Ser. No. 12/634,453 titled LED SOCKET ASSEMBLY, U.S. patent application Ser. No. 12/634,492 titled SOLID STATE LIGHTING SYSTEM, and U.S. patent application Ser. No. 12/634,542 titled SOCKET ASSEMBLY WITH A THERMAL MANAGEMENT STRUCTURE, each filed concurrently herewith, the subject matter of each of which are herein incorporated by reference in their entirety.

BACKGROUND OF THE INVENTION

The subject matter herein relates generally to solid state lighting assemblies, and more particularly, to LED socket assemblies.

Solid-state light lighting systems use solid state light sources, such as light emitting diodes (LEDs), and are being used to replace other lighting systems that use other types of light sources, such as incandescent or fluorescent lamps. The solid-state light sources offer advantages over the lamps, such as rapid turn-on, rapid cycling (on-off-on) times, long useful life span, low power consumption, narrow emitted light bandwidths that eliminate the need for color filters to provide desired colors, and so on.

LED lighting systems typically include LEDs soldered down to a printed circuit board (PCB). The PCB then is mechanically and electrically attached to the lighting fixture. In known LED lighting systems, mechanical hardware and/or adhesives, epoxy or solder may be used to mount the PCB to the lighting fixture. Wires are soldered to the PCB to provide an electrical connection. These systems are not without disadvantages. For instance, problems arise when the LEDs or the PCB needs to be replaced in the future. The rework process is tedious and may require a skilled person to perform the removal and replacement. Additionally, the PCB typically includes many LEDs thereon, and if one of the LEDs malfunctions or does not work, then the entire PCB may need to be replaced.

A need remains for a lighting system that may be efficiently packaged into a lighting fixture. A need remains for a lighting system that may be efficiently configured for an end use application.

BRIEF DESCRIPTION OF THE INVENTION

In one embodiment, a socket assembly is provided that includes a light emitting diode (LED) package having an LED printed circuit board (PCB) with an LED mounted thereto. The LED package has a power contact configured to receive power from a power source to power the LED. The socket assembly also includes a socket housing having a receptacle that removably receives the LED package. The socket housing has a securing feature engaging the LED PCB to secure the LED PCB within the receptacle, where the securing feature is configured to release the LED PCB to remove the LED PCB from the receptacle. Optionally, the socket housing may include mounting features configured to mount the socket housing to a base, where the LED package is removable from the socket housing while the socket housing remains mounted to the base. A second LED package may be provided, where the LED package is removable from the receptacle and is replaced by the second LED package.

In another embodiment, a socket assembly is provided that includes a light emitting diode (LED) package having an LED printed circuit board (PCB) with an LED mounted thereto and a power contact. A socket housing is provided having a receptacle that removably receives the LED package. The socket housing has a securing feature engaging the LED PCB to secure the LED PCB within the receptacle. The securing feature is configured to release the LED PCB to remove the LED PCB from the receptacle. A power connector is coupled to the power contact and is configured to supply power to the power contact.

In a further embodiment, a socket assembly is provided including a first socket having a first socket housing with a first receptacle and a first light emitting diode (LED) package removably received in the first receptacle. The first LED package has a first LED printed circuit board (PCB) with first power contacts thereon. The socket assembly also includes a second socket having a second socket housing with a second receptacle and a second LED package removably received in the second receptacle. The second LED package has a second LED PCB with second power contacts thereon. A bridge power connector is mounted to the first socket housing and the second socket housing, where the bridge power connector has bridge contacts electrically connected to the first power contacts and the second power contacts.

DETAILED DESCRIPTION OF THE INVENTION

Figure 1:
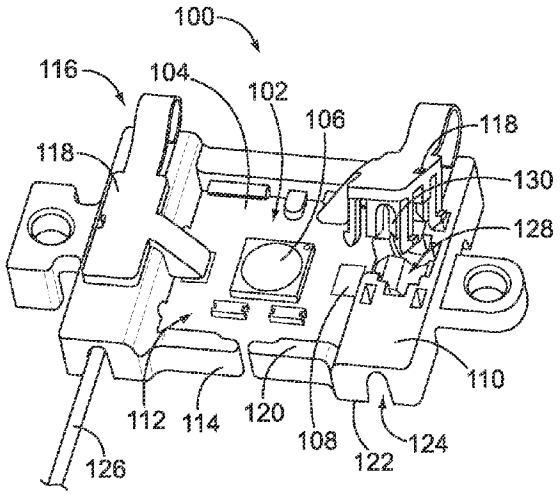
FIG. 1 is a top perspective view of a socket assembly formed in accordance with an exemplary embodiment.

FIG. 1 is a top perspective view of a socket assembly 100 formed in accordance with an exemplary embodiment. The assembly 100 is part of a light engine that is used for residential, commercial or industrial use. The assembly 100 may be used for general purpose lighting, or alternatively, may have a customized application or end use.

The assembly 100 includes a light emitting diode (LED) package 102 having an LED printed circuit board (PCB) 104 with an LED 106 mounted thereto. In the illustrated embodiment, a single LED 106 is mounted to the LED PCB 104, however it is realized that any number of LEDs 106 may be mounted to the LED PCB 104. The LED PCB 104 may be sized appropriately depending on the number of LEDs 106 mounted thereto. The LED package 102 includes a plurality of power contacts 108 on the LED PCB 104. In the illustrated embodiment, the power contacts 108 are positioned proximate opposite edges of the LED PCB 104. Alternative arrangements of the power contacts 108 are possible in alternative embodiments. For example, the power contacts 108 may all be positioned proximate to one edge of the LED PCB 104. Any number of power contacts 108 may be provided, including a single power contact 108. While the power contacts 108 are illustrated as being contact pads on a surface of the LED PCB 104, the power contacts 108 may have a different structure in alternative embodiments, such as a plug or receptacle type of connector mounted to the LED PCB 104, pin contacts extending from the LED PCB 104, insulation displacement contacts terminated to the LED PCB 104, and the like.

The assembly 100 also includes a socket housing 110 having a receptacle 112 that removably receives the LED package 102. The socket housing 110 has at least one securing feature 114 engaging the LED PCB 104 to secure the LED PCB 104 within the receptacle 112. The securing feature 114 is configured to release the LED PCB 104 to remove the LED PCB 104 from the receptacle 112. The LED package 102 and the socket housing 110 together define an individual socket 116 of the assembly 100. Any number of sockets 116 may be combined to form the assembly 100. For example, the sockets 116 may be ganged together or may be daisy-chained together. The sockets 116 may be physically connected together in addition to being electrically connected together.

The assembly 100 also includes one or more power connectors 118 coupled to corresponding power contacts 108. The power connectors 118 are configured to supply power to the power contact 108, such as from a power source. The power connectors 118 may also be configured to transfer power from one assembly 100 to another or between individual sockets 116 of the assembly 100. The power connectors 118 may be mechanically secured to the socket housing 110, such as is the case in the illustrated embodiment. Alternatively, the power connectors 118 may be both mechanically and electrically coupled to the LED PCB 104.

The socket housing 110 includes a top 120 and a bottom 122. The top 120 is open and is configured to receive the LED package 102 therethrough. The bottom 122 may rest on a support structure, such as a base or heat sink (not shown) of the lighting fixture or light engine. Optionally, the bottom 122 may be open below the receptacle 112 such that the LED package 102 may similarly rest on the base or heat sink.

The securing features 114 represent deflectable latches at a front of the socket housing 110, and may be referred to hereinafter as deflectable latches 114. The deflectable latches 114 may be deflected outward from the receptacle 112 to allow clearance for removing the LED package 102 from the receptacle 112. For example, after the deflectable latches 114 are deflected, the front of the LED PCB 104 may be lifted upward to clear the deflectable latches 114, and then the LED PCB 104 may be pulled out of the receptacle 112 at an angle.

The socket housing 110 includes wire slots 124 on opposite sides of the receptacle 112. The wire slots 124 receive wires 126 therein. In an exemplary embodiment, the power connectors 118 may be received within pockets 128 associated with the wire slots 124 to make an electrical connection with the wires 126. For example, the power connectors 118 may be initially removed from the pockets 128 so that the wires 126 can be loaded into the wire slots 124. Once the wires 126 are positioned, the power connectors 118 may be loaded into the pockets 128 to mate with the wires 126. In an exemplary embodiment, the power connectors 118 include insulation displacement contacts (IDCs) 130 that pierce the insulation of the wires 126 and make electrical connection with the conductors of the wires 126. Other types of mating are possible in alternative embodiments. For example, the socket housing 110 may have a poke-in type of connection, wherein the wires 126 are simply received in corresponding openings and mate with poke-in contacts held in the openings. The power connector 118 may represent either a plug or jack that receives a corresponding mating part from a wire. Optionally, the power connectors 118 may be integral with the socket housing 110. For example, the power connectors 118 may be connected to the socket housing 110 by a tether or living hinge formed integral with the socket housing 110. Alternatively, the power connectors 118 may represent a separate and distinct component that is coupled to the socket housing 110.

Figure 2:
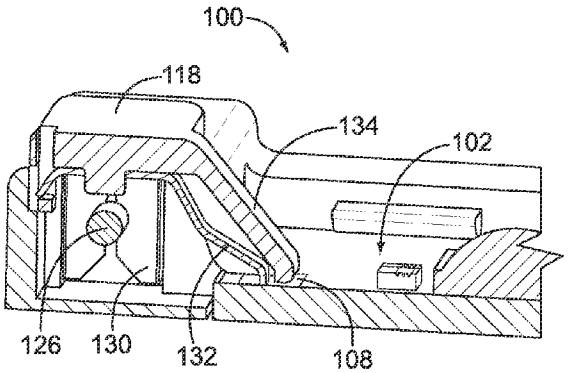
FIG. 2 is a partial cutaway view of the socket assembly shown in FIG. 1.

FIG. 2 is a partial cutaway view of the socket assembly 100 showing one of the power connectors 118 making an electrical connection with the corresponding wire 126. The IDC 130 electrically terminates to the wire 126. The power connector 118 includes a mating contact 132 that is electrically connected to the IDC 130 and that engages the power contact 108 to make an electrical connection with the LED package 102. The mating contact 132 represents a spring contact that may be biased against the power contact 108 to ensure engagement between the power contact 108 and the mating contact 132. Optionally, the mating contact 132 may be integral with the IDC 130. The power connector 118 includes a cover 134 for the mating contact 132.

Figure 3:
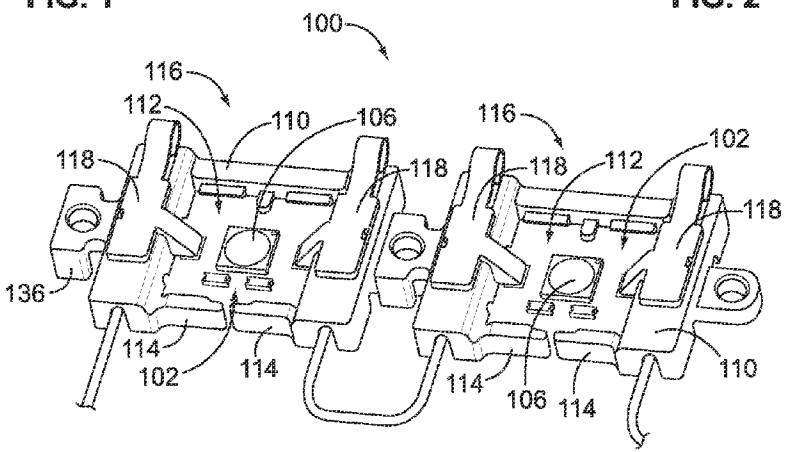
FIG. 3 is a top perspective view of the socket assembly shown in FIG. 1 with a plurality of sockets ganged together.

FIG. 3 is a top perspective view of the socket assembly 100 with a plurality of sockets 116 ganged together. The sockets 116 are physically joined together using mounting features 136, 138 extending from opposite sides of the socket housings 110. The mounting features 136, 138 secure the sockets 116 together and may also secure the sockets 116 to the base or heat sink (not shown). In the illustrated embodiment, the first mounting feature 136 represents a female coupler and the second mounting feature 138 represents a male coupler received in the female coupler. A fastener (not shown) may pass through the mounting features 136, 138 to secure the sockets 116 to one another and/or to the base.

In an exemplary embodiment, the sockets 116 are arranged in series, wherein power is passed through one socket 116 (e.g. the left socket) to the adjacent socket (e.g. the right socket). The power may be passed from that socket 116 to another socket arranged downstream thereof. Alternatively, the sockets 116 may be arranged in parallel with each socket receiving a separate power supply, such as from a different branch line for each socket 116. The power supply is not transferred through any of the sockets to any other sockets.

In use, any of the LED packages 102 may be quickly and easily removed from the corresponding socket housing 110 without removing the socket housing 110 from the base. For example, the LED package 102 may be removed by disconnecting the power connectors 118, then deflecting the securing features 114 to free the LED package 102. The LED package 102 may then be lifted out of the receptacle 112 and replaced with a new LED package 102. As such, defective LED packages 102 (e.g. LED packages 102 having defective LEDs 106) may be removed and replaced quickly and efficiently without the need to disturb any other socket 116. Each of the socket housings 110 may remain coupled to the base once initially installed, and only the LED packages 102 need be removed and replaced. Additionally, because each LED package 102 only has one LED 106, only the defective LED 106 need be replaced.

Figure 4:
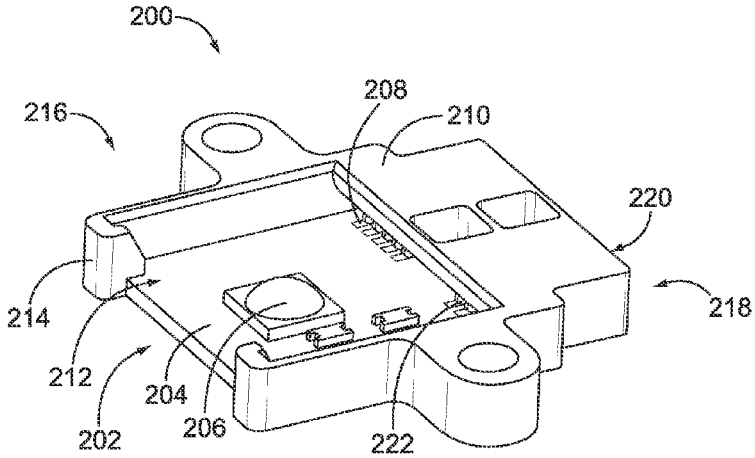
FIG. 4 is a top perspective view of another socket assembly formed in accordance with an alternative embodiment.
Figure 5:
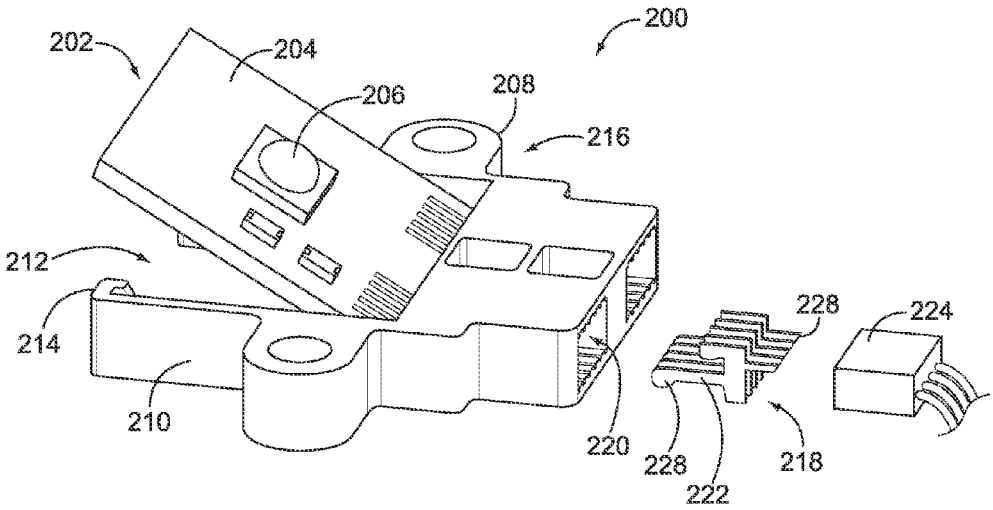
FIG. 5 is an exploded view of the socket assembly shown in FIG. 4.

FIG. 4 is a top perspective view of another socket assembly 200 formed in accordance with an alternative embodiment. FIG. 5 is an exploded view of the socket assembly 200.

The assembly 200 includes an LED package 202 having an LED PCB 204 with an LED 206 mounted thereto. The LED package 202 includes a plurality of power contacts 208 on the LED PCB 204. In the illustrated embodiment, the power contacts 208 are positioned proximate one of the edges of the LED PCB 204. Any number of power contacts 208 may be provided.

The assembly 200 also includes a socket housing 210 having a receptacle 212 that removably receives the LED package 202. The LED package 202 and the socket housing 210 together define an individual socket 216 of the assembly 200. Any number of sockets 216 may be combined to form the assembly 210. The socket housing 210 has at least one securing feature 214 engaging the LED PCB 204 to secure the LED PCB 204 within the receptacle 212. The securing features 214 represent deflectable latches at a front of the socket housing 210, and may be referred to hereinafter as deflectable latches 214. The deflectable latches 214 may be deflected outward from the receptacle 212 to allow clearance for removing the LED package 202 from the receptacle 212. For example, after the deflectable latches 214 are deflected, the front of the LED PCB 204 may be lifted upward to clear the deflectable latches 214, and then the LED PCB 204 may be pulled out of the receptacle 212 at an angle.

The assembly 200 also includes power connectors 218 coupled to corresponding power contacts 208. The power connectors 218 are configured to supply power to the power contact 208, such as from a power source. Each power connector 218 includes a port 220 (shown in FIG. 5) formed in the socket housing 210 and individual mating contacts 222 positioned within the port 220. The port 220 is configured to receive a plug 224 from a power source. The mating contacts 222 having mating tips 226 that engage the power contacts 208 on the LED PCB 204. The mating contacts 222 also include pins 228 that mate with the plug 224 received in the port 220.

Figure 6:
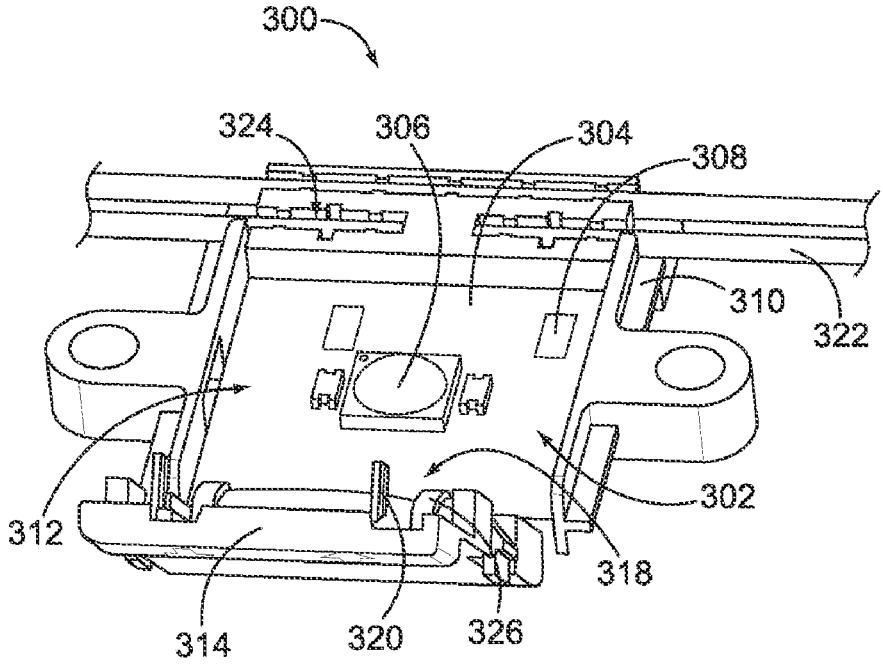
FIG. 6 is a top perspective view of yet another socket assembly formed in accordance with an alternative embodiment showing the socket assembly in an unmated state.
Figure 7:
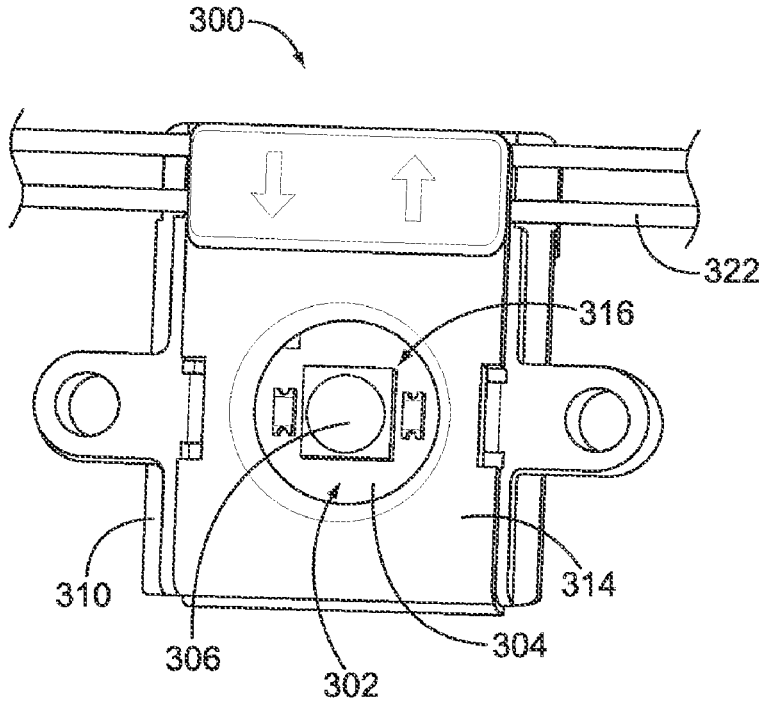
FIG. 7 shows the socket assembly of FIG. 6 in a mated state.

FIG. 6 is a top perspective view of yet another socket assembly 300 formed in accordance with an alternative embodiment showing the socket assembly 300 in an unmated state. FIG. 7 shows the socket assembly 300 in a mated state.

The assembly 300 includes an LED package 302 having an LED PCB 304 with an LED 306 mounted thereto. The LED package 302 includes a plurality of power contacts 308 on the LED PCB 304. In the illustrated embodiment, the power contacts 308 are arranged remote from the edges of the LED PCB 304, however the power contacts 308 may be positioned anywhere along the LED PCB 304 in alternative embodiments. Two power contacts 308 are illustrated, however any number of power contacts 308 may be provided.

The assembly 300 also includes a socket housing 310 having a receptacle 312 that removably receives the LED package 302. The socket housing 310 has at least one securing feature 314 engaging the LED PCB 304 to secure the LED PCB 304 within the receptacle 312. In the illustrated embodiment, the securing feature 314 is represented by a cover that is hingedly coupled to the socket housing 310, and may be referred to hereinafter as cover 314. In the unmated state (FIG. 6), the cover 314 is open and provides access to the receptacle 312. In the mated state (FIG. 7), the cover 314 is closed and is mated with the socket housing 310 to lock the cover 314 to the socket housing 310. In the mated position, the LED package 302 is secured within the receptacle 312. The cover 314 includes an opening 316 aligned with the LED 306. The LED 306 is received in the opening 316 when the cover 314 is closed to allow the light therefrom to emit beyond the socket housing 310.

The assembly 300 also includes a power connector 318 that is coupled to corresponding power contacts 308 in the mated state (FIG. 7). The power connector 318 are configured to supply power to the power contact 308, such as from a power source. The power connector 318 is integrated into the cover 314 and includes IDCs 320 that terminate to wires 322 held in wire slots 324 in the socket housing 310 when the cover 314 is in the mated position (FIG. 7). The power connector 318 also includes mating contacts 326 electrically connected to corresponding IDCs 320. The mating contacts 326 engage the power contacts 308 when the cover 314 is in the mated state.

Figure 8:
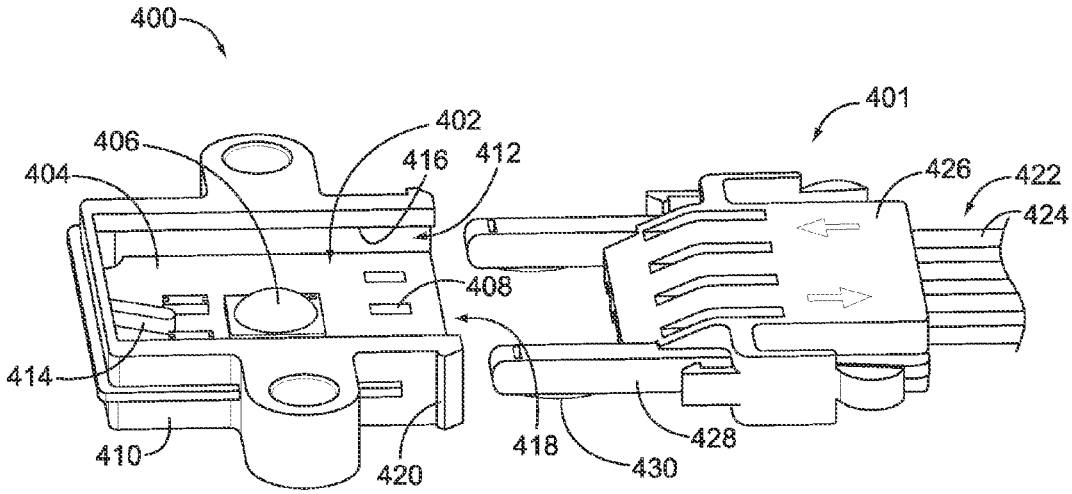
FIG. 8 is a top perspective view of another socket assembly formed in accordance with an alternative embodiment showing a power connector for powering the socket assembly.

FIG. 8 is a top perspective view of another socket assembly 400 formed in accordance with an alternative embodiment showing a power connector 401 for powering the socket assembly 400. The assembly 400 includes an LED package 402 having an LED PCB 404 with an LED 406 mounted thereto. The LED package 402 includes a plurality of power contacts 408 on the LED PCB 404. In the illustrated embodiment, the power contacts 408 are arranged proximate to an edges of the LED PCB 404.

The assembly 400 also includes a socket housing 410 having a receptacle 412 that removably receives the LED package 402. The socket housing 410 has at least one securing feature 414 engaging the LED PCB 404 to secure the LED PCB 404 within the receptacle 412. The securing feature 414 represents an arm at a rear of the socket housing 210 that holds the rear of the LED PCB 404 down, such as against the base or heat sink (not shown). The socket housing 410 also includes ledges 416 that hold the power connector 401 in place against the LED PCB 404, which also operates as a securing feature. The socket housing 410 includes an open front 418 providing access to the receptacle 412, and through which the LED package 402 and the power connector 401 are loaded. The socket housing 410 includes latching features 420 at the front that interact with the power connector 401 to hold the power connector 401 within the receptacle 412.

The power connector 401 is received in the receptacle 412 through the open front 418 and is coupled to the power contacts 408 within the receptacle 412. The power connector 401 may be provided at an end of a cable 422 having individual wires 424. The power connector 401 includes a connector body 426 that may be secured to the socket housing 410. In an exemplary embodiment, the power connector 401 includes arms 428 that extend forward from the connector body 426. The arms 428 extend along the LED PCB 404 and hold the LED PCB 404 down within the receptacle 412, such as against a heat sink. Optionally, spring beams 430 may be provided along a bottom of the arms 428 to engage the LED PCB 404 and bias against the LED PCB 404 to aid in pushing the LED PCB 404 downward. The power connector 401 supplies power to the power contacts 408, such as from a power source.

Figure 9:
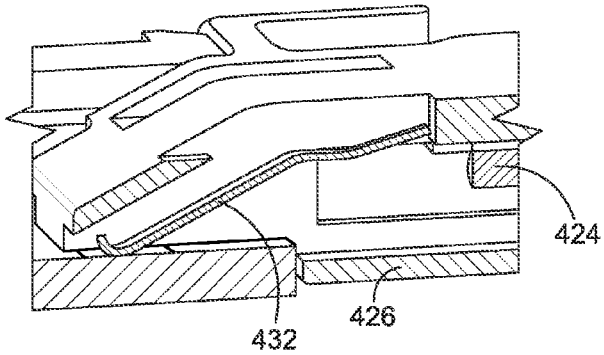
FIG. 9 is a partial cutaway view of the socket assembly shown in FIG. 8.

FIG. 9 is a partial cutaway view of the socket assembly 400 showing the power connector 401 mated with the LED package 402. The power connector 401 includes mating contacts 432 within the connector body 426. The mating contacts 432 engage the power contacts 408 to supply power to the LED package 402. The mating contacts 432 constitute spring contacts that are configured to be spring biased against the power contacts 408 to ensure good electrical connection therebetween. The mating contacts 432 are terminated to the wires 424, such as by a crimp connection. Other types of connections are possible in alternative embodiments.

Figure 10:
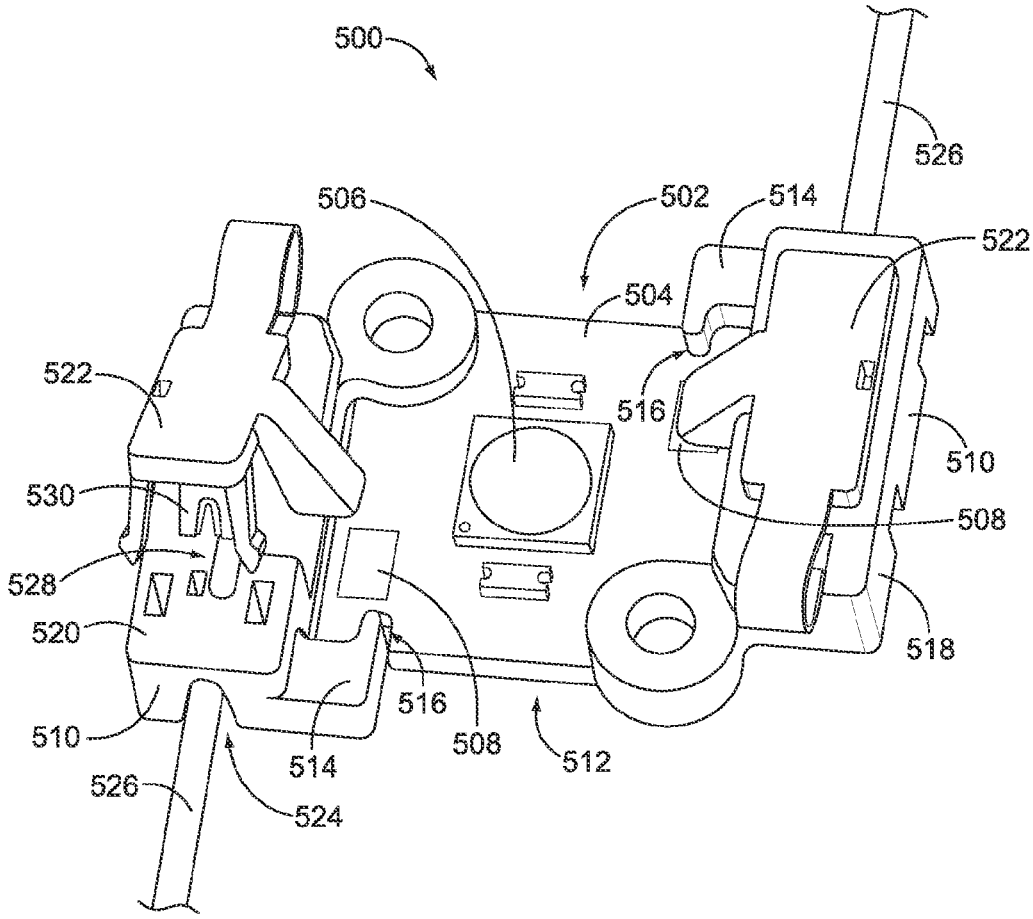
FIG. 10 is a top perspective view of a further socket assembly formed in accordance with an exemplary embodiment.

FIG. 10 is a top perspective view of a further socket assembly 500 formed in accordance with an exemplary embodiment. The assembly 500 includes an LED package 502 having an LED PCB 504 with an LED 506 mounted thereto. The LED package 502 includes a plurality of power contacts 508 on the LED PCB 504.

The assembly 500 also includes a socket housing 510 having a receptacle 512 that removably receives the LED package 502. The socket housing 510 has at least one securing feature 514 engaging the LED PCB 504 to secure the LED PCB 504 within the receptacle 512. In the illustrated embodiment, the securing features 514 represent hooks that are configured to be received in corresponding pockets 516 formed in the ends of the LED PCB 504. The hooks capture the LED PCB 504 and hold the LED PCB 504 in position with respect to the socket housing 510. The socket housings 510 are removed to release the LED PCB 504.

The socket housing 510 includes a first housing part 518 and a second housing part 520. The housing parts 520 are identical to one another and cooperate to define the receptacle 512 that holds the LED package 502. In the illustrated embodiment, the housing parts 518, 520 are separate and distinct from one another. The housing parts 518, 520 do not physically engage one another. Rather, the housing parts 518, 520 are positioned proximate one another to define the receptacle 512 therebetween. Each housing part 518, 520 holds an opposite side and an opposite end of the LED PCB 504 to hold the LED PCB 504 in position. In an exemplary embodiment, each housing part 518, 520 includes one of the securing features 514 to secure the LED PCB 504 within the receptacle 512. The securing features 514 locate the LED PCB 504 within the receptacle 512 and may operate as anti-rotational features. The housing parts 518, 520 may be separately secured to a base or heat sink (not shown).

The assembly 500 also includes one or more power connectors 522 coupled to corresponding power contacts 508. The power connectors 522 are configured to supply power to the power contact 508, such as from a power source.

Each of the housing parts 518, 520 of the socket housing 510 includes a wire slot 524 that receives a wire 526 therein. In an exemplary embodiment, the power connectors 522 may be received within pockets 528 in the housing parts 518, 520 to make an electrical connection with the wires 526. For example, the power connectors 522 may be initially removed from the pockets 528 so that the wires 526 can be loaded into the wire slots 524. Once the wires 526 are positioned, the power connectors 522 may be loaded into the pockets 528 to mate with the wires 526. In an exemplary embodiment, the power connectors 522 include insulation displacement contacts (IDCs) 530 that pierce the insulation of the wires 526 and make electrical connection with the conductors of the wires 526. Other types of mating are possible in alternative embodiments. Optionally, the power connectors 522 may be integral with the socket housing 510. For example, the power connectors 522 may be connected to the socket housing 510 by a tether or living hinge formed integral with the socket housing 510.

Figure 11:
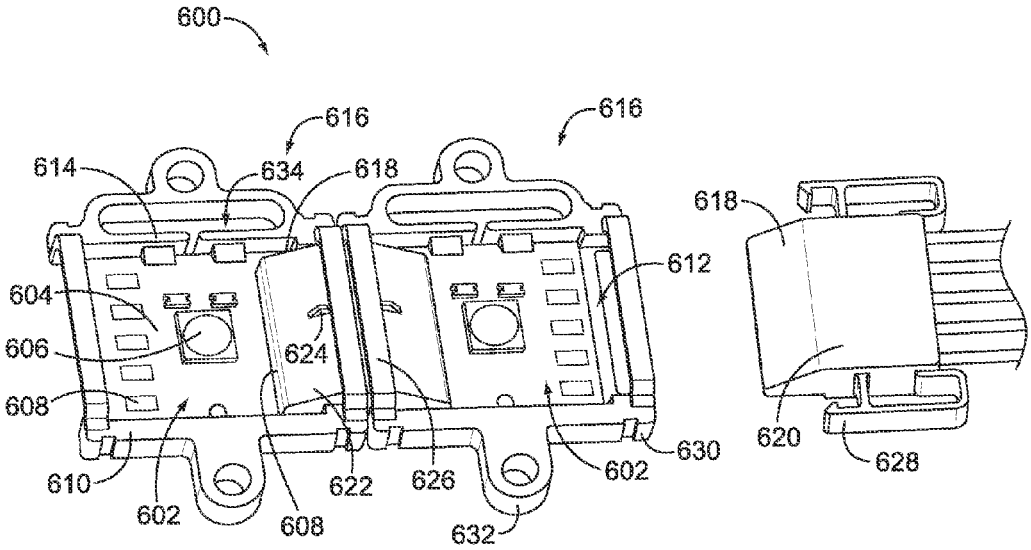
FIG. 11 is a top perspective view of another socket assembly formed in accordance with an exemplary embodiment.

FIG. 11 is a top perspective view of another socket assembly 600 formed in accordance with an exemplary embodiment. The assembly 600 includes an LED package 602 having an LED PCB 604 with an LED 606 mounted thereto. The LED package 602 includes a plurality of power contacts 608 on the LED PCB 604. In the illustrated embodiment, the power contacts 608 are arranged along opposite edges of the LED PCB 604, however the power contacts 608 may be positioned anywhere along the LED PCB 604 in alternative embodiments.

The assembly 600 also includes a socket housing 610 having a receptacle 612 that removably receives the LED package 602. The socket housing 610 has at least one securing feature 614 engaging the LED PCB 604 to secure the LED PCB 604 within the receptacle 612. In the illustrated embodiment, the securing features 614 are represented by deflectable latches at a front of the socket housing 610, and may be referred to hereinafter as deflectable latches 614. The deflectable latches 614 may be deflected outward from the receptacle 612 to allow clearance for removing the LED package 602 from the receptacle 612. The LED package 602 and the socket housing 610 together define an individual socket 616 of the assembly 600. While two sockets 616 are shown ganged together in FIG. 11, it is realized that any number of sockets 616 may be combined to form the assembly 600.

The assembly 600 also includes power connectors 618 that are coupled to corresponding power contacts 608 of the sockets 616. The power connectors 618 are configured to supply power to the power contact 608, such as from a power source. In the illustrated embodiment, the power connectors 618 include different types of power connectors, such as a supply connector 620 that originates at a power supply (not shown) and that supplies power to the assembly 600. The power connectors 618 also include a bridge connector 622 that electrically connects adjacent sockets 616 together. The bridge connector 622 is physically and electrically connected to the first socket 616 (on the right) and the second socket 616 (on the left). The bridge connector 622 includes bridge contacts (not shown) that engage the power contacts 608 on both the first and second sockets 616 to transfer power from one socket 616 to the next.

The bridge connector 622 includes latching features 624 that engage corresponding latching features 626 on the socket housings 610 to secure the bridge connector 622 to the socket housings 610. Similarly, the supply connector 620 includes latching features 628 that engage corresponding latching features 630 on the socket housing 610 to secure the supply connector 620 to the socket housing 610.

The socket housings 610 include mounting features 632 for mounting the socket housings 610 to the base or heat sink (not shown). The deflectable latches 614 may be deflected to allow removal of the PCB packages 602 while the socket housings 610 remain mounted to the base or heat sink. Optionally, a window 634 may be provided outward of the deflectable latches 614 to allow a space for the latches 614 to deflect.

Figure 12:
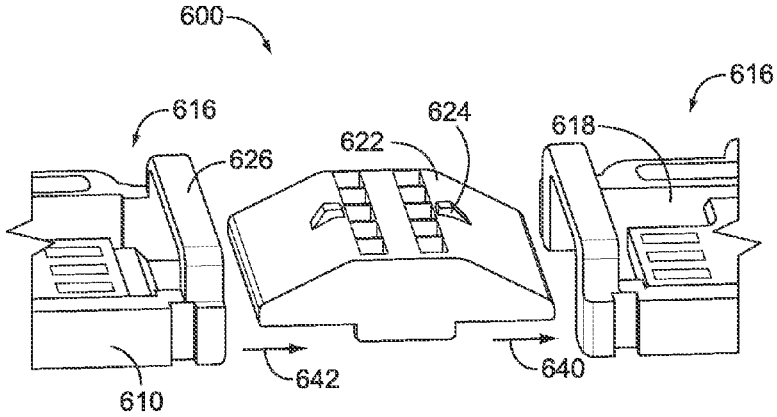
FIG. 12 is an exploded view of a portion of the socket assembly shown in FIG. 11.

FIG. 12 is an exploded view of a portion of the socket assembly 600 showing the bridge connector 622 between the sockets 616. Optionally, the bridge connector 622 may be assembled between the sockets 616 after the LED packages 602 are loaded into the corresponding socket housings 610. The bridge connector 622 may be loaded into both socket housings 610 from one side or the other after the socket housings 610 are positioned adjacent one another. Alternatively, the bridge connector 622 may be loaded into the socket housings 610 prior to mounting socket housings 610 to the heat sink, such as shown by the arrows 640, 642. The latching features 624 are represented by tabs and the latching features 626 are represented by hoods that wrap over the top of the bridge connector 622. The tabs engage the hoods to secure the bridge connector 622 in position with respect to the socket housings 610.

Figure 13:
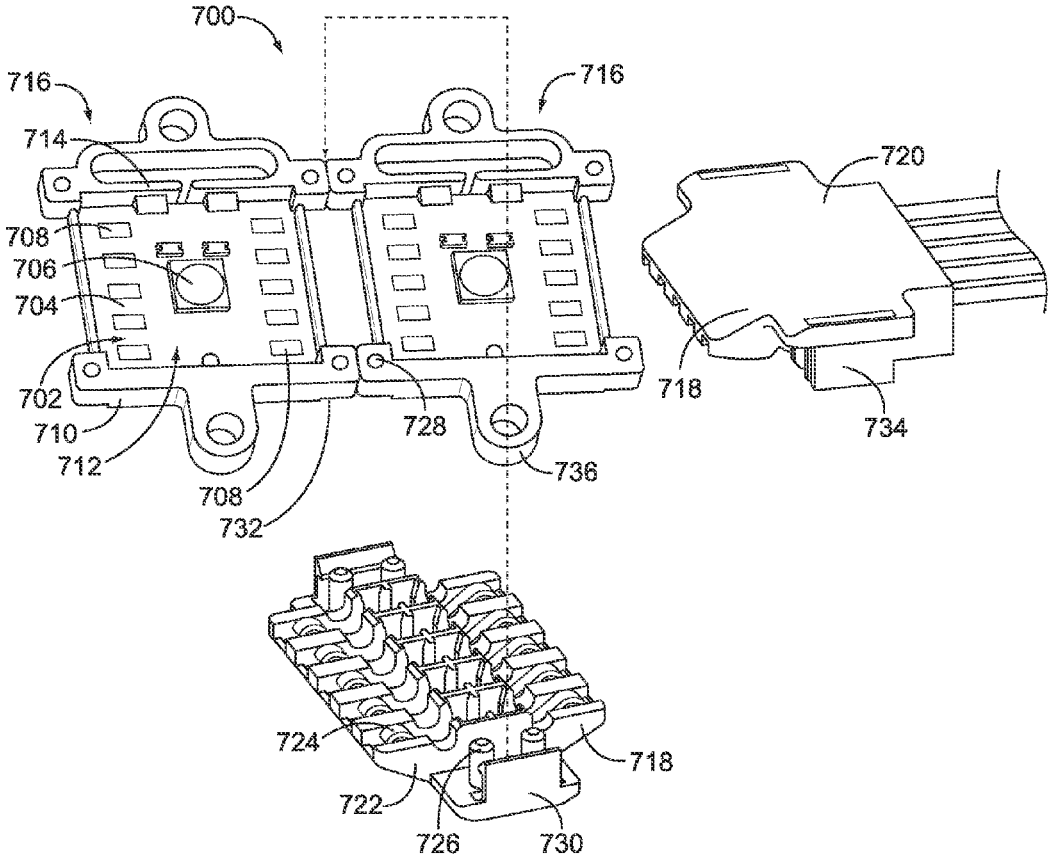
FIG. 13 is an exploded view of another socket assembly formed in accordance with an alternative embodiment.

FIG. 13 is an exploded view of another socket assembly 700 formed in accordance with an alternative embodiment. The assembly 700 is similar to the assembly 600 (shown in FIGS. 11 and 12), however the assembly 700 includes power connectors that differ from the power connectors 618 (shown in FIGS. 11 and 12).

The assembly 700 includes an LED package 702 having an LED PCB 704 with an LED 706 mounted thereto. The LED package 702 includes a plurality of power contacts 708 on the LED PCB 704. The assembly 700 also includes a socket housing 710 having a receptacle 712 that removably receives the LED package 702. The socket housing 710 has at least one securing feature 714 engaging the LED PCB 704 to secure the LED PCB 704 within the receptacle 712. The LED package 702 and the socket housing 710 together define an individual socket 716 of the assembly 700. While two sockets 716 are shown ganged together in FIG. 13, it is realized that any number of sockets 716 may be combined to form the assembly 700.

The assembly 700 also includes power connectors 718 that are coupled to corresponding power contacts 708 of the sockets 716. The power connectors 718 are configured to supply power to the power contact 708, such as from a power source. In the illustrated embodiment, the power connectors 718 include a supply connector 720 and a bridge connector 722 that is configured to electrically connect the adjacent sockets 716 together. The bottom of the bridge connector 722 is illustrated in FIG. 13 showing bridge contacts 724 that are configured to engage the corresponding power contacts 708. When mounted to the sockets 716, the bridge connector 722 is physically and electrically connected to the first socket 716 (on the right) and the second socket 716 (on the left). The bridge contacts 724 transfer power from one socket 716 to the next.

The bridge connector 722 includes orientation features 726, represented by pegs, that engage corresponding orientation features 728, represented by openings that receive the pegs, on the socket housings 710 to orient the bridge connector 722 to the socket housings 710. The bridge connector 722 includes latching features 730, represented by latches, that engage corresponding latching features 732, represented by catches that receive the latches, on the socket housings 710 to secure the bridge connector 722 to the socket housings 710. Other types of orientation features 726, 728 and/or latching features 730, 732 may be used in alternative embodiments to secure the bridge connector 722 to the socket housings 710. The supply connector 720 includes similar orientation features (not shown) and latching features 734 that secure the supply connector 720 to the socket housing 710. The socket housings 710 include mounting features 736 for mounting the socket housings 710 to the base or heat sink (not shown).

Figure 14:
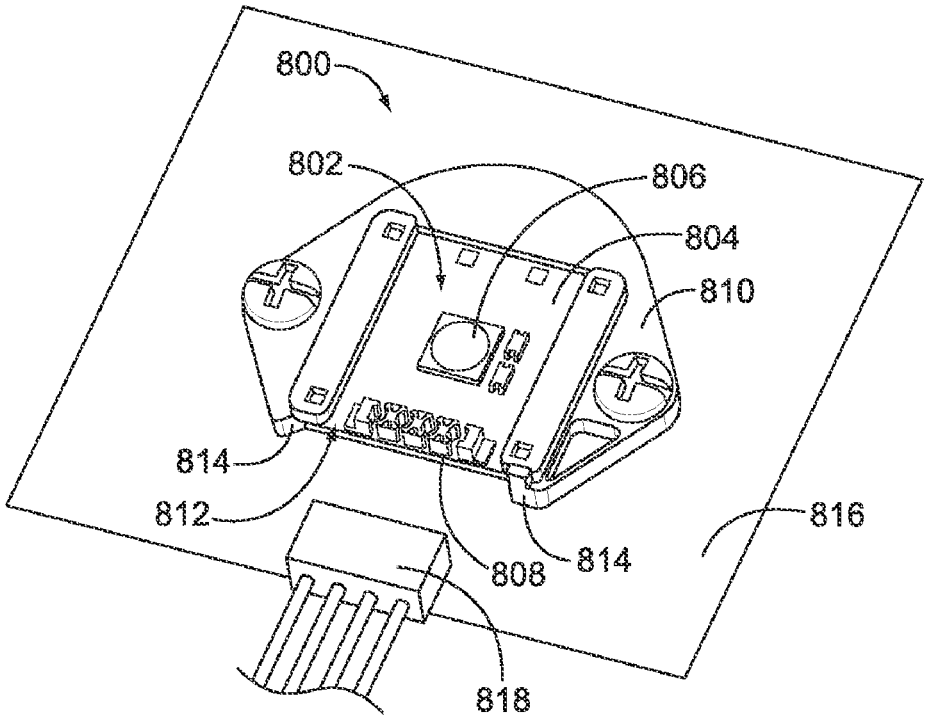
FIG. 14 is a top perspective view of yet another socket assembly formed in accordance with an exemplary embodiment.

FIG. 14 is a top perspective view of yet another socket assembly 800 formed in accordance with an exemplary embodiment. The assembly 800 includes an LED package 802 having an LED PCB 804 with an LED 806 mounted thereto. The LED package 802 includes a plurality of power contacts 808 on the LED PCB 804. In the illustrated embodiment, the power contacts 808 are held within receptacles of a connector and mounted to individual pads on the LED PCB 804. Alternatively, the power contacts 808 may be through hole mounted to the LED PCB 804 rather than surface mounted. The power contacts 808 are arranged at a front edge of the LED PCB 804, however the power contacts 808 could be on multiple sides or edges.

The assembly 800 also includes a socket housing 810 having a receptacle 812 that removably receives the LED package 802. The socket housing 810 has an open front through which the LED package 802 is loaded and securing features 814 at the open front. The securing features 814 engage the LED PCB 804 to secure the LED PCB 804 within the receptacle 812. In the illustrated embodiment, the securing features 814 are represented by a deflectable latch on one side (e.g. right side) and a non-deflectable latch on the opposite side (e.g. left side). Alternatively, only the deflectable latch may be provided with no latch on the other side. The LED package 802 and the socket housing 810 are mounted to a heat sink 816, such as using fasteners. The LED package 802 directly engages the heat sink 816 to dissipate the heat generated by the LED 806.

The assembly 800 also includes a power connector 818 that is configured to be coupled to the power contacts 808. The power connector 818 supplies power to the power contacts 808, such as from a power source. In the illustrated embodiment, the power connector 818 includes mating contacts (not shown) that interface with the power contacts 808.

Figure 15:
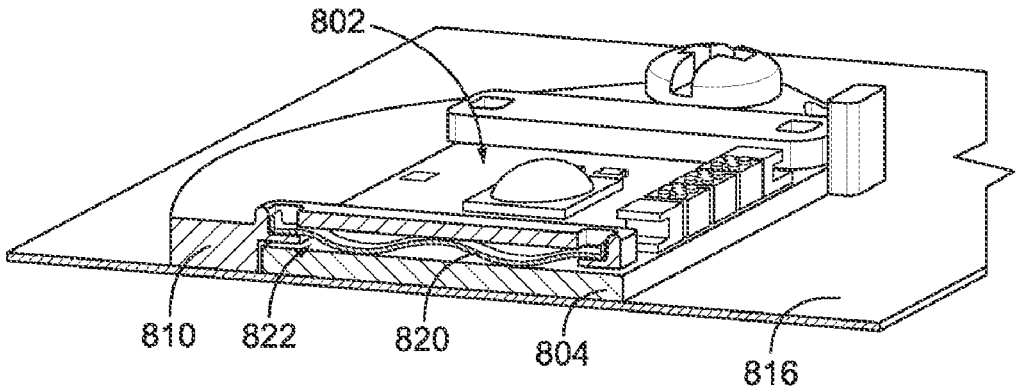
FIG. 15 is a partial cutaway view of the socket assembly shown in FIG. 14.

FIG. 15 is a partial cutaway view of the socket assembly 800. The socket housing 810 includes a spring contact 820 held within a pocket 822. The spring contact 820 engages the top surface of the LED PCB 804 and is biased against the LED PCB 804. The spring contact 820 pushes the LED PCB 804 downward against the heat sink 816. A similar spring contact may be provided on the opposite side of the socket housing 810 to hold down the opposite side of the LED PCB 804.

Figure 16:
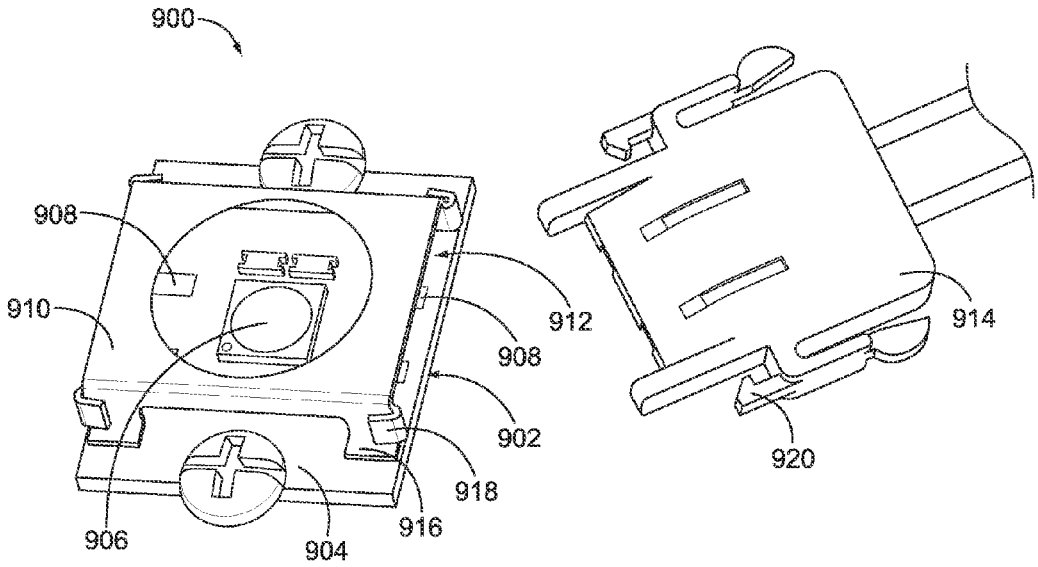
FIG. 16 is a top perspective view of another socket assembly formed in accordance with an exemplary embodiment.

FIG. 16 is a top perspective view of another socket assembly 900 formed in accordance with an exemplary embodiment. The assembly 900 includes an LED package 902 having an LED PCB 904 with an LED 906 mounted thereto. The LED package 902 includes a plurality of power contacts 908 on the LED PCB 904. In the illustrated embodiment, the power contacts 908 are represented by contact pads on the LED PCB 904. The power contacts 908 are arranged proximate to opposite edges of the LED PCB 904. The LED PCB 904 may be mounted to a base or heat sink (not shown), such as using fasteners.

The assembly 900 also includes a socket housing 910 having a receptacle 912 that removably receives one or more power connectors 914. The socket housing 910 is mounted to the LED PCB 904. For example, the socket housing 910 includes pads 916 soldered to the LED PCB 904. The socket housing 910 includes securing features 918 at the front and rear thereon. The power connectors 914 include latches 920 that engage the securing features 918 to secure the power connectors 914 within the receptacle 912. The power connectors 914 include mating contacts (not shown) that are configured to be coupled to the power contacts 908. The power connector 914 supplies power to the power contacts 908, such as from a power source. The power connectors 914 may be coupled to both sides of the receptacle 912, where one power connector 914 supplies power to the LED package 902 from a power source, and the other power connector 914 transfers power from the LED package 902 to a downstream socket. As such, the LED packages 902 may be daisy-chained by intermediate power connectors 914.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A socket assembly comprising:

a light emitting diode (LED) package having an LED printed circuit board (PCB) with an LED mounted thereto, the LED package having a power contact configured to receive power from a power source to power the LED; and a socket housing having a receptacle that removably receives the LED package, the socket housing having a securing feature engaging the LED PCB to secure the LED PCB within the receptacle, the securing feature being configured to release the LED PCB to remove the LED PCB from the receptacle, the securing feature being movable between a mated position and a released position, in the mated position, the securing feature engages and blocks removal of the LED PCB from the receptacle, in the released position, the securing feature provides clearance for removal of the LED PCB from the receptacle.

2. The assembly of claim 1, wherein the socket housing includes mounting features configured to mount the socket housing to a base, the LED package being removable from the socket housing while the socket housing remains mounted to the base.

3. The assembly of claim 1, further comprising a second LED package, the LED package being removable from the receptacle and replaced by the second LED package.

4. The assembly of claim 1, further comprising a power connector coupled to the power contact of the LED package, the power connector being configured to supply power to the power connector.

5. The assembly of claim 1, wherein the housing includes a wire slot configured to hold a wire therein, the assembly further comprising a power connector having an insulation displacement contact for terminating to the wire, the power connector being coupled to the power contact.

6. The assembly of claim 1, further comprising:

a second socket housing having a second receptacle that removably receives a second LED package having a second LED PCB; and a bridge power connector mounted to the socket housing and the second socket housing, the bridge power connector having bridge contacts electrically connected to the LED PCB and the second LED PCB.

7. The assembly of claim 1, wherein the securing feature comprises deflectable latches that are movable between the mated and the released positions.

8. The assembly of claim 1, wherein the securing feature comprises a cover that is at least one of removable from the socket housing or rotatably coupled to the socket housing.

9. The assembly of claim 1, wherein the socket housing includes an open top, the LED emitting light through the open top, the LED package being loaded into and removable from the receptacle through the open top of the socket housing.

10. A socket assembly comprising:

a light emitting diode (LED) package having an LED printed circuit board (PCB) with an LED mounted thereto, the LED package having a power contact;

a socket housing having a receptacle that removably receives the LED package, the socket housing having a securing feature engaging the LED PCB to secure the LED PCB within the receptacle, the securing feature being configured to release the LED PCB to remove the LED PCB from the receptacle, the securing feature being movable between a mated position and a released position, in the mated position, the securing feature engages and blocks removal of the LED PCB from the receptacle in the released position the securing feature provides clearance for removal of the LED PCB from the receptacle, wherein the socket housing includes mounting features configured to mount the socket housing to a base, the LED package being removable from the socket housing while the socket housing remains mounted to the base; and a power connector coupled to the power contact, the power connector being configured to supply power to the power contact.

11. The assembly of claim 10, wherein the housing includes a wire slot configured to hold a wire therein, the power connector having an insulation displacement contact being terminated to the wire.

12. The assembly of claim 10, wherein the power connector includes a linkage connected to the socket housing such that the power connector is permanently, physically coupled to the socket housing.

13. The assembly of claim 10, further comprising a second socket housing having a second receptacle that removably receives a second LED package and a second power connector interconnecting the LED package and the second LED package.

14. The assembly of claim 10, further comprising:

a second socket housing having a second receptacle that removably receives a second LED package having a second LED PCB; and a bridge power connector mounted to the socket housing and the second socket housing, the bridge power connector having bridge contacts electrically connected to the LED PCB and the second LED PCB.

15. The assembly of claim 10, wherein the socket housing includes an open top, the LED emitting light through the open top, the LED package being loaded into and removable from the receptacle through the open top of the socket housing.

16. A socket assembly comprising:

a first socket comprising a first socket housing having a first receptacle, the first socket comprising a first light emitting diode (LED) package removably received in the first receptacle, the first LED package having a first LED printed circuit board (PCB) with first power contacts thereon;

a second socket comprising a second socket housing having a second receptacle, the second socket comprising a second LED package removably received in the second receptacle, the second LED package having a second LED PCB with second power contacts thereon; and a bridge power connector mounted to the first socket housing and the second socket housing, the bridge power connector having bridge contacts electrically connected to the first power contacts and the second power contacts.

17. The assembly of claim 16, wherein the first and second housings include latching features engaging corresponding latching features on the bridge power connector to secure the bridge power connector to the first and second housings.

18. The assembly of claim 16, wherein the bridge power connector both mechanically and electrically connects the first and second sockets together.

19. The assembly of claim 16, further comprising a power connector electrically connected to the first LED package to supply power to the first LED PCB, the power supplied to the first LED PCB being transferred to the second LED PCB by the bridge power connector.

20. The assembly of claim 16, wherein the socket housing includes an open top, the LED emitting light through the open top, the LED package being loaded into and removable from the receptacle through the open top of the socket housing.

* * * * *